US005609109A

United States Patent [19]

Berg

[11] Patent Number: 5,609,109

[45] **Date of Patent: *Mar. 11, 1997**

[54] FRAME BRACE INTEGRAL CROSS BRACE SUPPORT BRACKET

[75] Inventor: Thomas R. Berg, Clarendon Hills, Ill.

[73] Assignee: Standard Research and Design Corporation, Park Ridge, Ill.

[ * ] Notice: The term of this patent shall not extend beyond the expiration date of Pat. No. 5,461,986.

[21] Appl. No.: 526,204

[22] Filed: Sep. 11, 1995

Related U.S. Application Data

[63] Continuation-in-part of Ser. No. 270,505, Jul. 5, 1994, Pat. No. 5,461,986.

[51] Int. Cl.[6] ..... B61F 5/00

[52] U.S. Cl. ..... 105/206.1; 105/182.1

[58] Field of Search ..... 105/182.1, 206.1, 105/206.2, 209, 229, 165, 167, 168

[56] References Cited

U.S. PATENT DOCUMENTS

| | | | |
|---|---|---|---|
| 2,170,119 | 8/1939 | Busch | 105/206.1 |
| 2,170,123 | 8/1939 | Busch | 105/206.1 |
| 2,170,188 | 8/1939 | Busch | 105/206.1 |
| 4,570,544 | 2/1986 | Smith | 105/224.1 |
| 4,870,914 | 10/1989 | Radwill | 105/206.2 |
| 5,243,920 | 9/1993 | Lamson et al. | 105/182.1 |
| 5,461,986 | 10/1995 | Sarnicki et al. | 105/182.1 |

FOREIGN PATENT DOCUMENTS

| | | | |
|---|---|---|---|
| 0494643 | 7/1950 | Belgium | 105/206.1 |

*Primary Examiner*—Mark T. Le

*Attorney, Agent, or Firm*—Dorn, McEachran, Jambor & Keating

[57] ABSTRACT

A rail car truck side frame for use in a frame brace truck which has stabilizing cross braces extending between the side frames. The side frame has a top compression member and a bottom tension member which are joined by upwardly and outwardly slanted end walls. There is a bracket at the lower end of each end wall for use in mounting a cross brace. The bracket includes first, second and third walls, each integral with the side frame and each extending downwardly from the side frame. The first wall forms the wall for attachment of a cross brace with the second and third walls being perpendicular to the first wall and forming support for the first wall.

5 Claims, 2 Drawing Sheets

Fig.3.
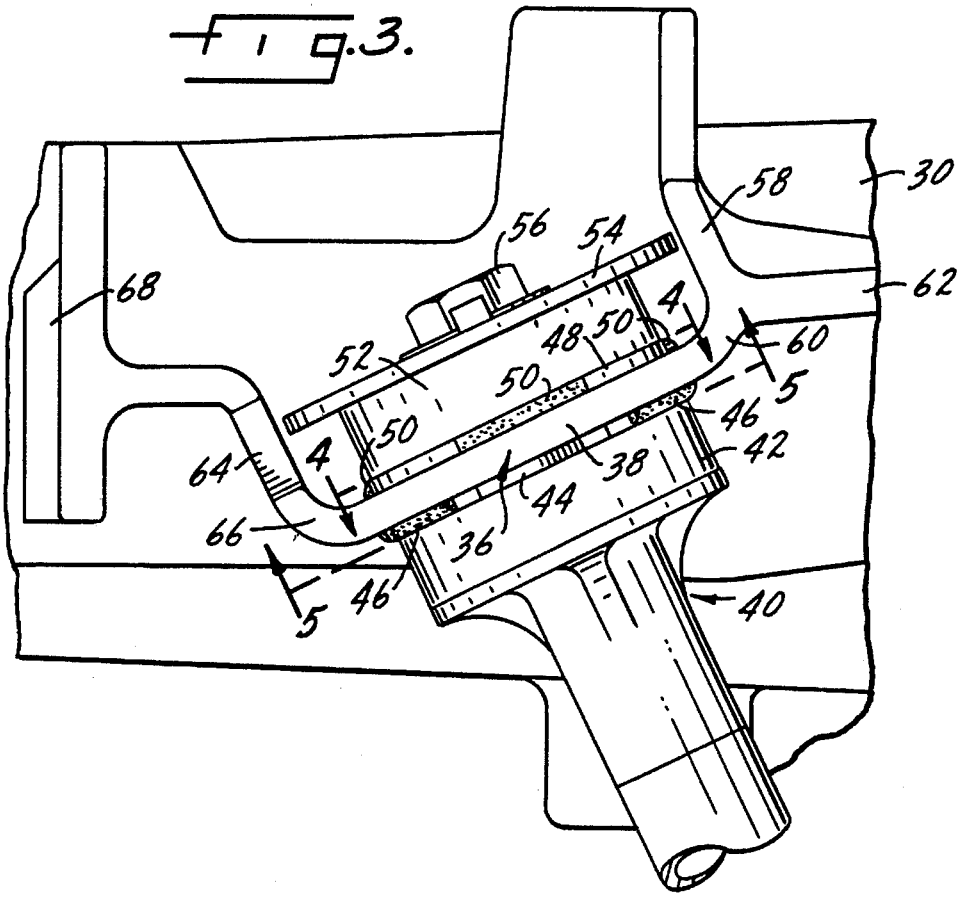
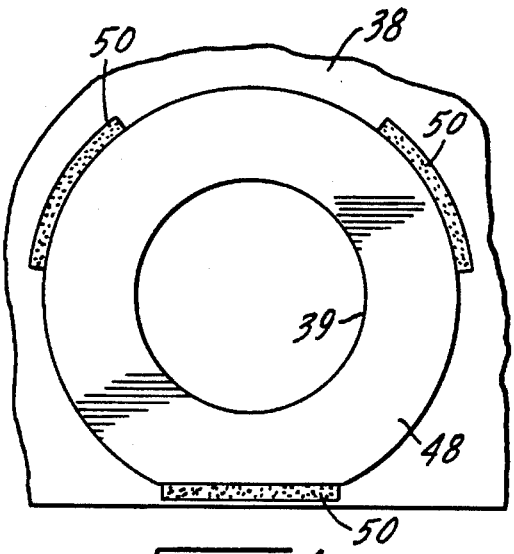
Fig.4.
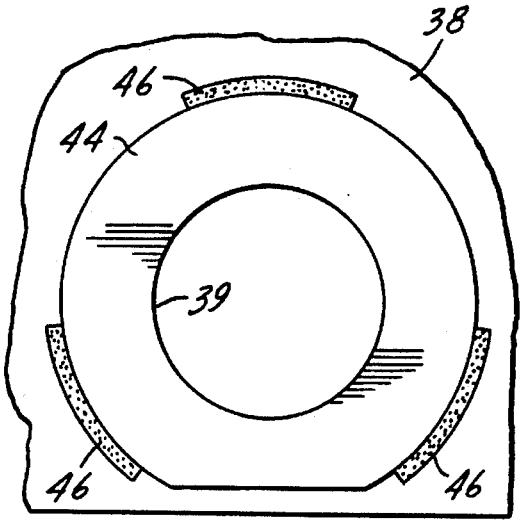
Fig.5.

FRAME BRACE INTEGRAL CROSS BRACE SUPPORT BRACKET

This is a continuation-in-part of application Ser. No. 270,505, filed Jul. 5, 1994, now U.S. Pat. No. 5,461,986, issued Oct. 31, 1995.

THE FIELD OF THE INVENTION

The present invention relates to frame brace rail car trucks of the type described in U.S. Pat. Nos. 4,570,544, 4,870,914 and 5,243,920, two of which are assigned to the assignee of the present application, Standard Research and Design Corporation of Park Ridge, Ill. In the '914 patent the cross braces are mounted to brackets which are formed of a plurality of walls having flanges and a plate 75 which may be positioned between the flanges or in the slot formed by the flanges with the plate being welded therein. The present invention is an improvement on what is shown in the '914 patent as the entire bracket for supporting a cross strut or cross brace is integrally cast with the side free. This provides a simplified and more economical construction than that illustrated in the '914 patent.

SUMMARY OF THE INVENTION

The present invention relates to frame brace trucks in which a pair of cross struts are used to stabilize the truck and in particular to an improved integral mounting for the cross struts.

A primary purpose of the invention is an improved and substantially strengthened bracket for use on the side frame of a frame brace truck to mount the truck cross struts.

Another purpose is to provide a side frame bracket of the type described which is more economical and stronger than the previous welded assemblies.

Other purposes will appear in the ensuing specification, drawings and claims.

BRIEF DESCRIPTION OF THE DRAWINGS

The invention is illustrated diagrammatically in the following drawings wherein:

FIG. 3 is an enlarged partial bottom view illustrating the cross strut support bracket;

FIG. 4 is a section along plane 4—4 of FIG. 3; and

FIG. 5 is a section along plane 5—5 of FIG. 3.

DESCRIPTION OF THE PREFERRED EMBODIMENT

Figure 1:
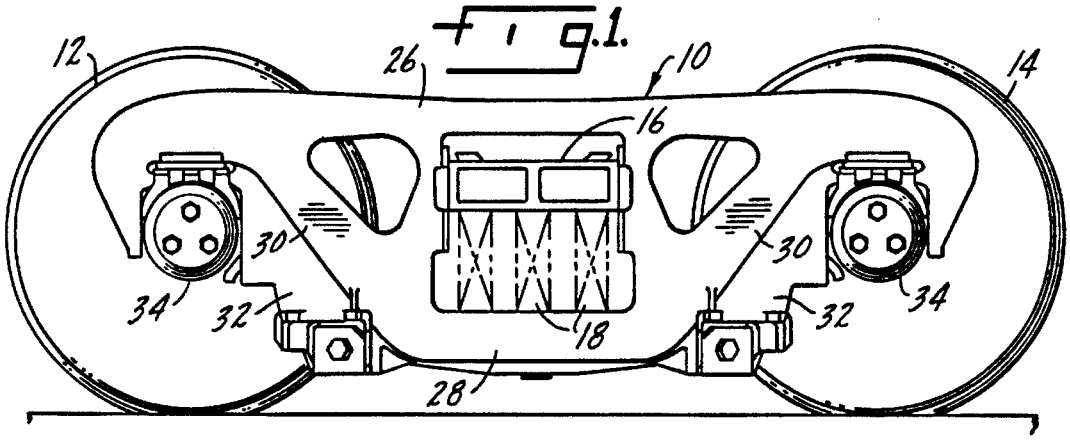
FIG. 1 is a side view of a rail car truck of the type described.
Figure 2:
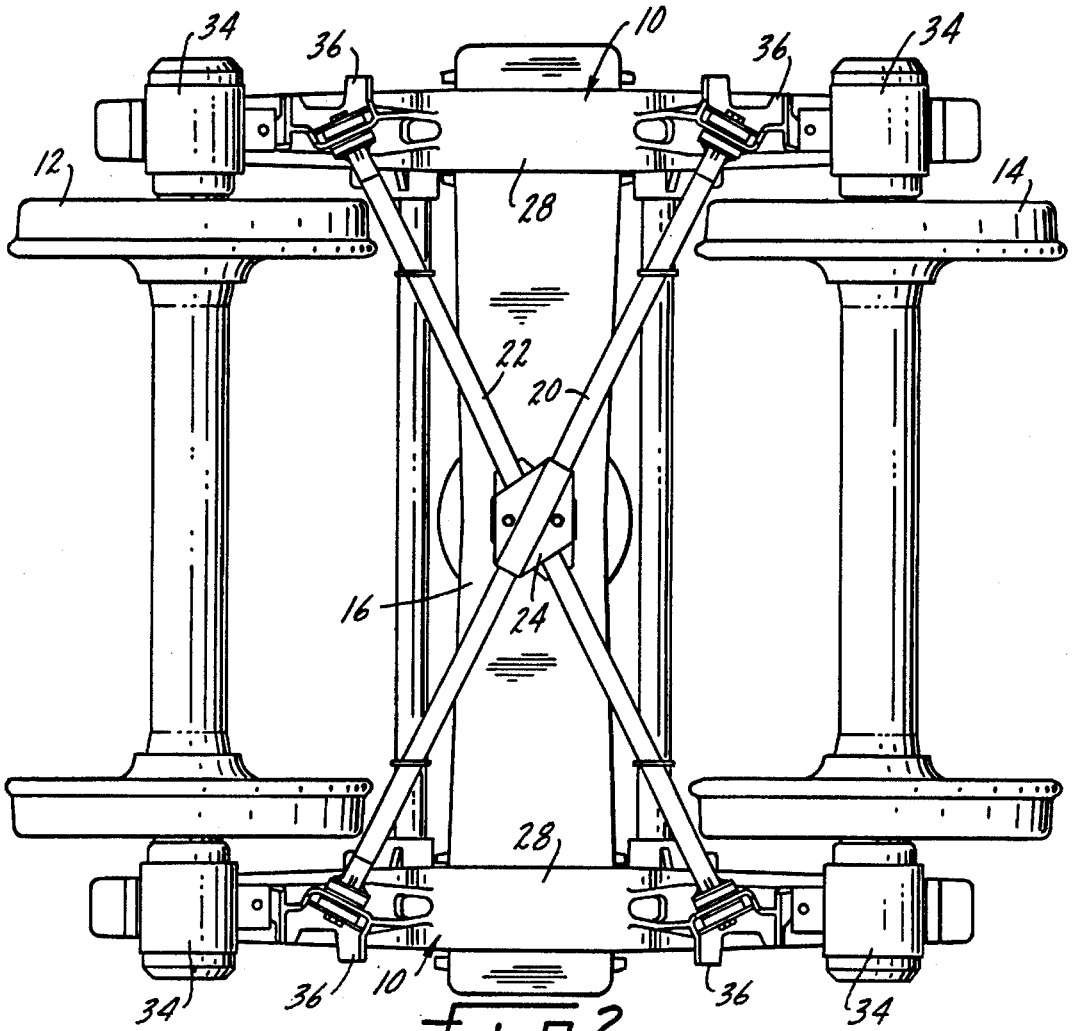
FIG. 2 is a bottom view of the truck of FIG. 1.

U.S. Pat. No. 4,570,544 discloses a rail car truck having a pair of side frames supported on conventional longitudinally spaced wheelsets. To improve truck stability, cross braces extend between the side frames to increase the resistance to side frame relative longitudinal movement. Elastomeric members are placed between the wheelsets and the side frame to decrease the yaw stiffness of the wheelsets. As a result, the yaw stiffness and lateral stiffness of the truck can be selected to provide optimum truck stability.

U.S. Pat. No. 5,243,920 discloses an improvement for the '544 truck specifically in the area of the clamp that holds the cross braces together at a location generally at the midpoint between the side frames. U.S. Pat. No. 4,870,914 shows an improvement in the area of the brackets that support the cross braces. The present invention is an improvement on the '914 patent in that the bracket is integrally cast with the side frame providing clear economy in the manufacture of the side frame and a side frame in which the cross strut mounting bracket is substantially stronger than the welded assembly of the '914 patent.

In the drawings, side frames are indicated at 10 and are mounted on wheelsets 12 and 14. Conventional roller bearings mount the wheelsets and the side frames are connected by a bolster 16. The bolster is supported on the side frame by springs 18.

Cross braces 20 and 22 are diagonally connected between the side frames to provide the desired resistance to relative longitudinal movement between the side frames. The cross braces are held together at their center by a clamp 24.

Each side frame includes an upper compression member 26 and a lower tension member 28, with the compression and tension members being Joined by integral outwardly and upwardly slanted end walls 30. Extending from the end walls 30 are portions 32 of the pedestal Jaws which form the openings by which the side frame is seated upon the roller bearings 34 at the end of each wheelset.

There is a bracket 36 which is used to mount each end of one of the cross struts 20, 22. The brackets are identical and one is shown in detail in FIGS. 3, 4 and 5. The bracket assembly includes what is termed a first wall 38 which extends generally vertically downwardly from the pedestal jaw portion 32 and forms an angle with the side frame such that the first wall 38 is perpendicular to the cross strut. The first wall will have an opening 39 for the mounting of the end block assembly indicated generally at 40. The end block assembly may include an elastomeric element 42 and a plate 44, with the plate 44 being welded, as at 46, to the inboard side of the first wall 38. 0n the outboard side of wall 38 there is a second steel plate 48 which is welded, as at 50, to the first wall 38 and spaces an elastomeric element 52 from a washer 54 with the entire assembly being held by a bolt 56 to the cross strut. Conventionally, the end block will have a nose which extends inside of the hollow cross strut for mounting purposes.

The first wall 38 is integral with a second wall 58 which also extends generally vertically downwardly from the pedestal Jaw portion 32 and from the angled endwall 30. Walls 38 and 58 are generally perpendicular with a curved Junction indicated at 60 therebetween. Extending rearwardly from the junction 60 is a bridge element 62 which is used in connection with car progressor devices found in loading terminals for bulk rail cars. The bridge 62 will also be integral with the side frame.

At the opposite side of wall 38 there is a third wall 64, also integral with the cast steel side frame and extending downwardly from the pedestal jaw portion 32. The third wall 64 Joins the first wall 38, again at a right angle, with the junction being formed by a curved area 66. Extending forwardly from the third wall 64 is a car progressor contact 68 which also functions in cooperation with car progressors which move bulk handling rail cars at loading terminals. The entire bracket assembly including the car progressor contact and the rearwardly extending bridge are all integral with the side frame and are cast as a unit when the side frame is manufactured.

The bracket shown for mounting the cross struts is located at the lower end of the upwardly angled wall 30 that joins the compression and tension members of the side frame. The bracket has an opening and it has three walls which form a U-shaped structure. The configuration of the bracket and the fact that it is integral with the side frame provide both economy in manufacture and a substantially strengthened bracket or support for the cross strut over what is shown in the prior art.

Whereas the preferred form of the invention has been shown and described herein, it should be realized that there may be many modifications, substitutions and alterations thereto.

The embodiments of the invention in which an exclusive property or privilege is claimed are defined as follows:

1. A side frame for use in a frame brace truck having stabilizing cross braces extending between the side frames, said side frame including a top compression member and a bottom tension member, upwardly and outwardly slanted end walls connecting said compression and tension members, and a bracket at the lower end of each said end wall for use in mounting a cross brace, each said bracket including a first wall integral with the side frame and extending downwardly therefrom, said first wall having an opening therein for the mounting of a cross brace, a second wall integral with said first wall and said side frame and extending downwardly therefrom, said second wall being generally perpendicular to said first wall, and a third wall integral with said first wall and said side frame and extending downwardly therefrom, said third wall being generally perpendicular to said first wall, with said first, second and third walls, in combination, forming a generally U-shaped bracket, integral with the side frame, for the mounting of a cross brace.

2. The side frame of claim 1 wherein the junction between said first wall and said second wall and the junction between said first wall and said third wall are curved.

3. The side frame of claim 1 wherein there is a rearwardly extending bridge element extending from the Junction of said first wall and said second wall toward said tension member.

4. The side frame of claim 1 wherein there is a forwardly extending integral projection integral with said third wall for use in providing a car progressor contact for said bracket.

5. A rail car truck including two parallel side frames and a bolster extending therebetween, a pair of struts oppositely inclined to the longitudinal axis of the truck and each extending between the side frames, and means for mounting the ends of said struts including a bracket having a first wall integral with the side frame and extending downwardly therefrom, a second wall integral with the first wall and with the side frame and extending downwardly therefrom, and a third wall integral with the side frame and with said first wall and extending downwardly from the side frame, said first, second and third walls, in combination, forming a U-shaped bracket for the mounting of a cross strut.

* * * * *